US005899660A

United States Patent [19]

Dodd

[11] Patent Number: 5,899,660

[45] Date of Patent: May 4, 1999

[54] GAS TURBINE ENGINE CASING

[75] Inventor: Alec G Dodd, Derby, United Kingdom

[73] Assignee: Rolls-Royce plc, London, United Kingdom

[21] Appl. No.: 08/844,321

[22] Filed: Apr. 18, 1997

[30] Foreign Application Priority Data

May 14, 1996 [GB] United Kingdom ..... 9610036

[51] Int. Cl.[6] ..... F01D 11/12

[52] U.S. Cl. ..... 415/9; 415/108; 415/115; 415/173.4; 415/173.5; 415/178; 415/214.1

[58] Field of Search ..... 415/9, 108, 115, 415/116, 173.4, 173.5, 173.6, 176, 177, 178, 200, 214.1

[56] References Cited

U.S. PATENT DOCUMENTS

| | | | |
|---|---|---|---|
| 2,930,521 | 3/1960 | Koehring | 415/173.4 |
| 4,264,274 | 4/1981 | Benedict . | |
| 4,867,639 | 9/1989 | Strangman . | |
| 5,408,826 | 4/1995 | Stewart et al. | 415/9 |
| 5,439,348 | 8/1995 | Hughes et al. | 415/173.4 |
| 5,447,411 | 9/1995 | Curley et al. | 415/9 |
| 5,485,723 | 1/1996 | McCoy et al. | 415/9 |
| 5,486,086 | 1/1996 | Bellia et al. | 415/9 |
| 5,645,399 | 7/1997 | Angus | 415/178 |

FOREIGN PATENT DOCUMENTS

| | | | |
|---|---|---|---|
| 74803 | 10/1952 | Denmark | 415/214.1 |
| 851323 | 10/1960 | United Kingdom | 415/173.4 |
| 904138 | 8/1962 | United Kingdom . | |
| 2037900 | 7/1980 | United Kingdom | 415/9 |
| 92/11444 | 7/1992 | WIPO | 415/108 |
| 92/17686 | 10/1992 | WIPO | 415/108 |

*Primary Examiner*—Christopher Verdier
*Attorney, Agent, or Firm*—W. Warren Taltavull; Farkas & Manelli Pllc

[57] ABSTRACT

A gas turbine engine casing includes a plurality of coaxially interconnected ring members each provided with a flange at each of their axial extents to facilitate interconnection of the ring members by bolts; each ring member is provided with an integral array of inwardly directed stator vanes and carries an abradable sealing material to cooperate with the tips of rotor blades of the engine.

10 Claims, 3 Drawing Sheets

GAS TURBINE ENGINE CASING

FIELD OF THE INVENTION

This invention relates to a casing for a gas turbine engine.

BACKGROUND OF THE INVENTION

Gas turbine engine casings are each commonly in the form of a hollow, open-ended container whose circular cross-section varies axially. The many separate non-rotatable components contained within the casing are directly or indirectly attached to the internal surface of the casing. Consequently, complete gas turbine engine modules, that is, casings containing all of their working components, are highly complicated assemblies that are costly to produce.

SUMMARY OF THE INVENTION

It is an object of the present invention to provide a gas turbine engine casing that facilitates the provision of gas turbine engine modules of reduced complexity.

According to the present invention, a gas turbine engine casing comprises a plurality of interconnected ring members coaxially arranged in series relationship, each of said ring members coaxially arranged in series relationship, each of said ring members having an annular array of radially inwardly directed stator aerofoil vanes integrally attached thereto and having means thereon to facilitate the attachment thereof to adjacent of said ring members whereby together said ring members define said casing, each of said ring members being of frusto-conical configuration at each of its axial extents to accommodate an abradable seal material attached thereto, said abradable seal material being so positioned on said ring members as to cooperate with the tips of aerofoil blades operationally located within said casing.

Such a gas turbine engine casing, when part of a gas turbine engine module, has the advantage of facilitating a module which has a reduced number of parts.

Preferably said abradable seal material is arranged in annular arrays, one array being positioned at the axial extent of each of said ring members so that the adjacent abradable material arrays of adjacent ring members operationally cooperate in sealing relationship with the tips of a single array of said aerofoil blades.

Each of said ring members may be provided with integral interconnected reinforcing ribs on its radially outer surface so as to define an isogrid structure.

BRIEF DESCRIPTION OF THE DRAWINGS

The present invention will now be described, by way of example, with reference to the accompanying drawings in which.

DETAILED DESCRIPTION OF THE INVENTION

Figure 1:
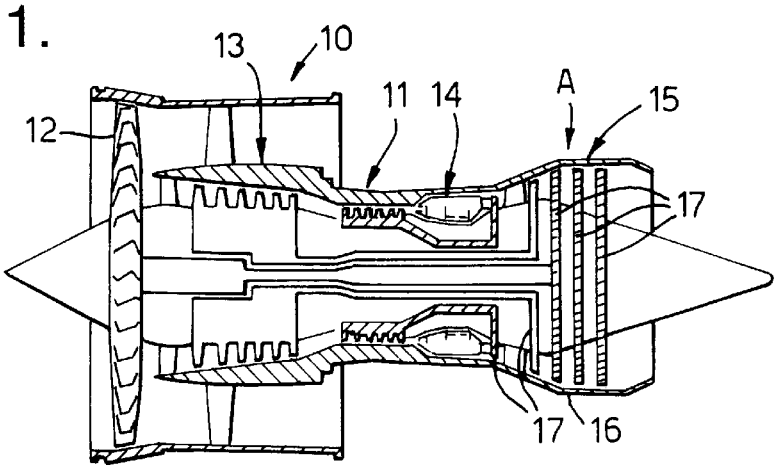
FIG. 1 is a partially sectioned schematic side view of a ducted fan gas turbine engine which includes a casing in accordance with the present invention.

With reference to FIG. 1, a ducted fan gas turbine engine generally indicated at 10 is of conventional overall configuration. Essentially it comprises a core unit 11 which drives a ducted fan 12. The ducted fan 12 provides the major portion of the engine's propulsive thrust while the exhaust efflux from the core unit 11 provides the remainder of the thrust.

The core unit 11 is made up of three main modules: the compressor module 13, the combustion module 14 and the turbine module 15. The present invention is concerned primarily with the turbine module 15, although it could be applied to the compressor module 13 if so desired.

Figure 2:
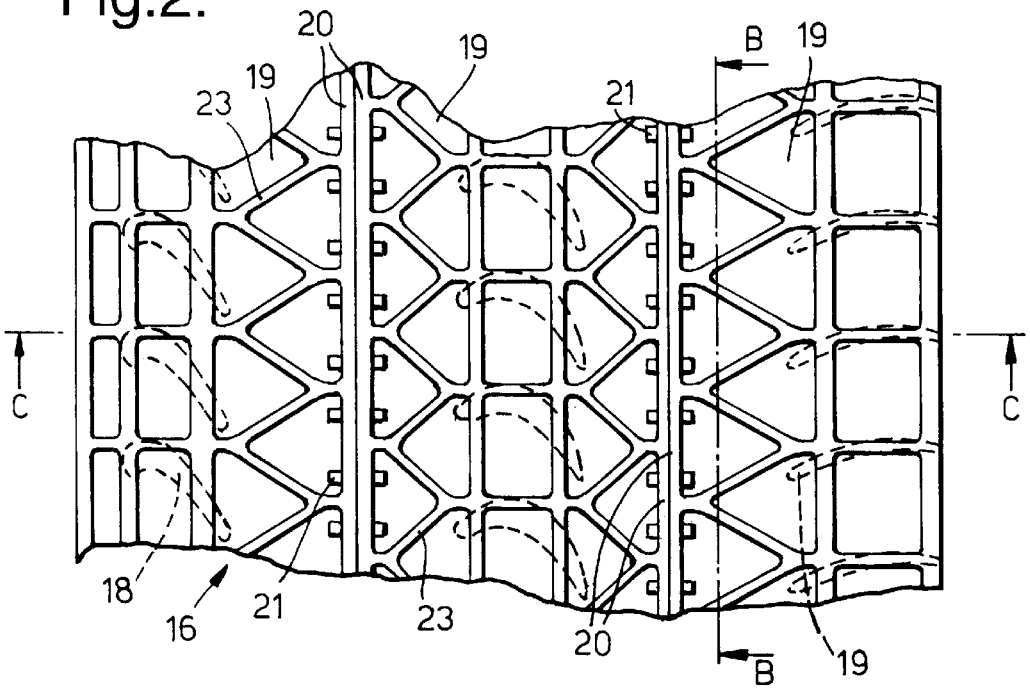
FIG. 2 is a view on arrow A of FIG. 1 showing a portion of the exterior of the low pressure turbine casing of the engine shown in FIG. 1, a part of the radially outer part of the casing assembly having been omitted in the interests of clarity.
Figure 3:
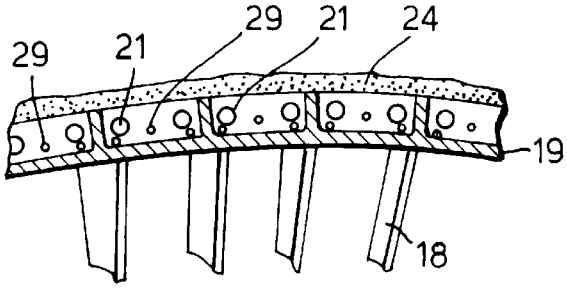
FIG. 3 is a view on section line B—B of FIG. 2.
Figure 4:
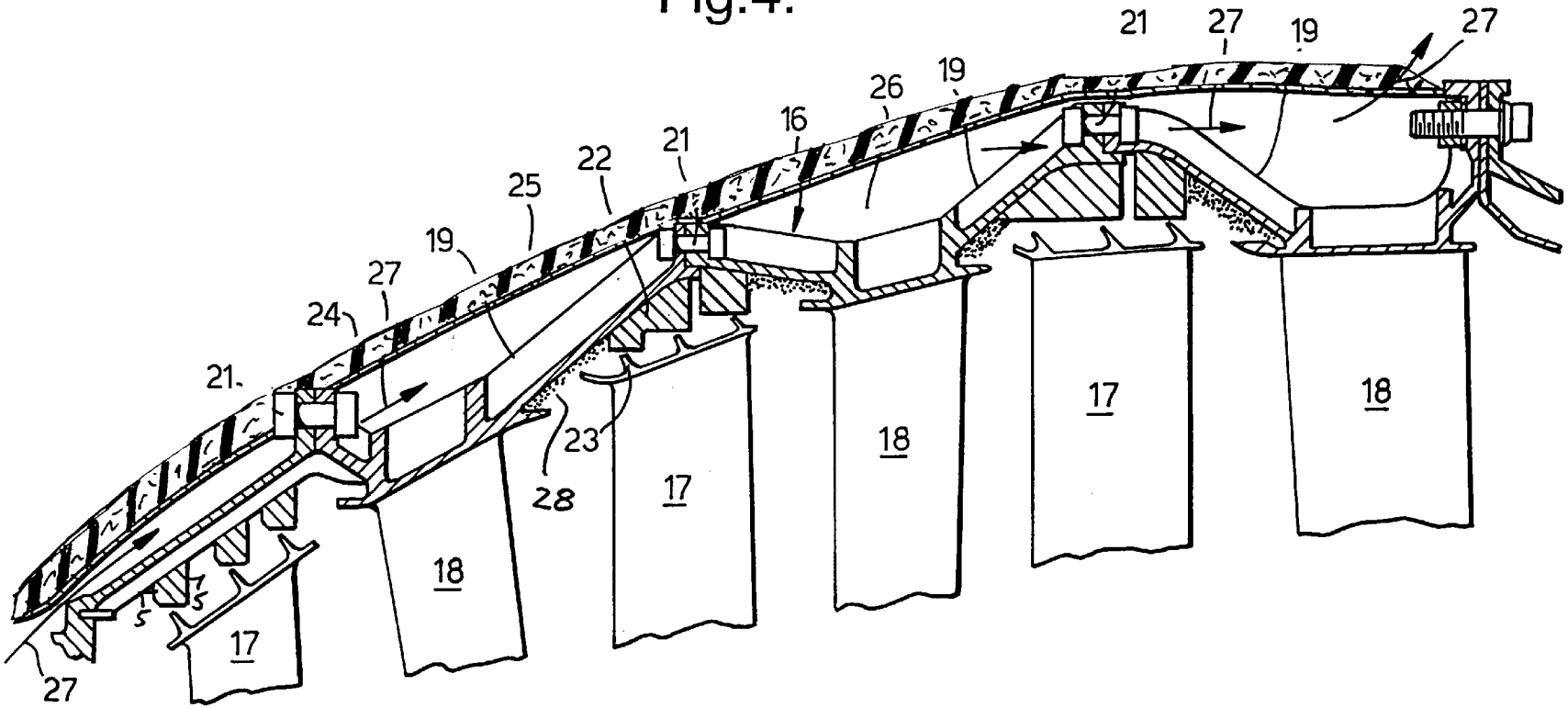
FIG. 4 is a view on section line C—C of FIG. 2.
Figure 5:
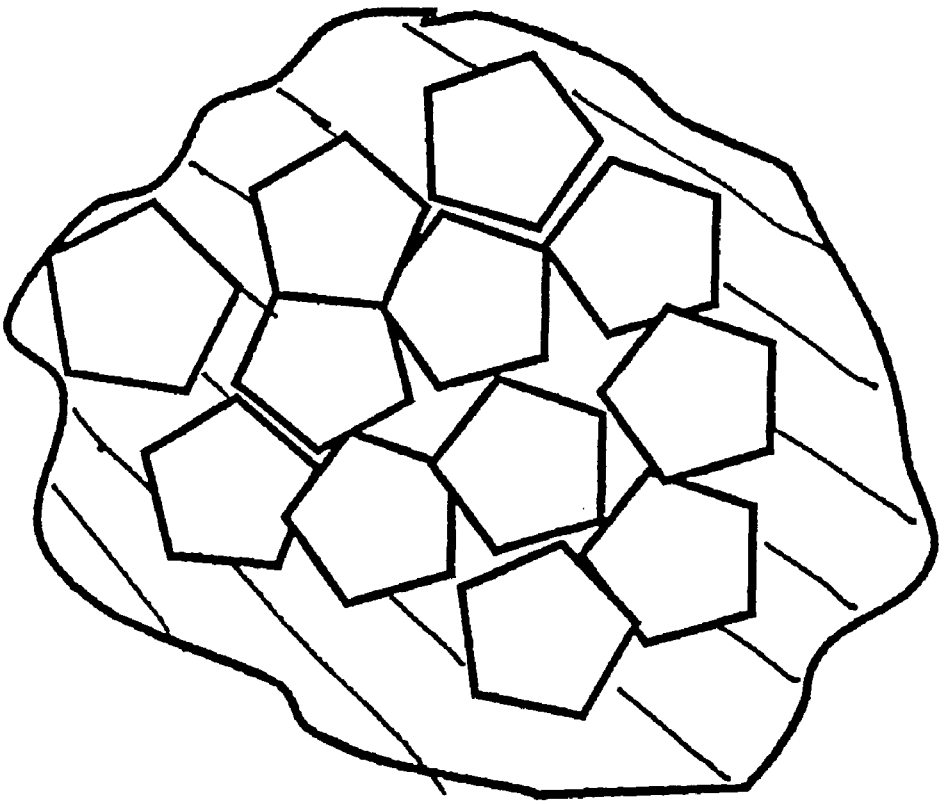
FIG. 5 is a sectional view along lines 5—5 of FIG. 4.

The turbine module 15 comprises a casing 16 which encloses axially alternate annular arrays of aerofoil rotor blades and stator vanes, although only the blades 17 can be seen in FIG. 1. Referring now to FIGS. 2–4, the stator vanes 18 are attached at their radially outer extents to the radially inner part of the turbine casing 16. Such an arrangement is conventional. However, in accordance with the present invention, the turbine casing 16 is not a single component as is normally the case. Instead, it is made up of a series of interconnected rings 19 which are coaxially arranged in series relationship. Moreover, each of the rings 19 has a single annular array of stator vanes 18 integral therewith.

Typically, each turbine casing ring 19 and its integral array of stator vanes 18 is cast as a single structure. Economies of manufacture are therefore enjoyed over conventional arrangements in which the casing is a single component to which individual stator vanes are attached. Each casing ring 19 is provided at its axial extents with circumferential flanges 20. The flanges 20 of adjacent casing rings 19 abut each other in sealing relationship and are maintained in that relationship by a plurality of bolts 21.

The joints between axially adjacent casing rings 19 coincide with the radially outer tips of the rotor aerofoil blades 17. In order to ensure an effective gas seal between each of the arrays of rotor blades 17 and the casing 16, a pair of annular sealing members 22 is attached to the radially inner surface of the casing 16 adjacent the tips of the aerofoil blades 17. The portions of each of the rings 19 between their stator vanes 18 and their axial extents are of generally frusto-conical form in order to accommodate the sealing members 22.

One sealing member 22 is attached by, for instance, brazing, to each of the adjacent casing rings 19 so as to interact with, and thereby define a gas seal with, sealing ribs 23 provided on the tips of the aerofoil blades 17. Each sealing member 22 is made up of an open metallic honeycomb support structure filled with an appropriate abradable material. Such sealing members are well known in the art and will not, therefore, be described in detail.

In order to ensure that the casing 16 is light, yet sufficiently rigid to withstand the rigours of normal turbine operation, the radially outer surfaces of the rings 19 are provided with a network of integral reinforcing ribs 22 which are arranged in a so-called "isogrid" pattern. However, although the ribs 22 impart a desirable degree of lightness and rigidity to the casing 16, the resulting thinness of the casing 16 means that if one of the rotor blades 17 should become detached, it is unlikely that the casing would be capable of containing it. Accordingly, therefore, several layers of glass fiber fabric 24 are positioned around the casing 16 in the manner described in GB2262313 in order to provide such containment.

The glass fiber fabric 24 is supported by an annular sheet metal cowl 25 which is mounted in radially spaced apart relationship with the casing 16 so that a generally annular passage 26 is defined the cowl 25 and casing 16. Cooling air indicated by the arrows 27 and derived from the engine compressor module 13 flows through the annular passage 26 to provide cooling of the turbine casing 16. The cooling air passes through holes 29 provided in the ribs 23 as can be seen in FIG. 3 and is exhausted from the passage 26 through outlet holes 27 provided at the downstream end of the cowl 25. Such cooling is necessary in order to protect the casing 19 from the hot gases which operationally flow over the turbine blades 17 and vanes 18.

Further thermal protection of the casing 16 is provided by a ceramic thermal barrier coating 28 which is applied to those portions of the radially inner surfaces of the rings 19 that are exposed to the hot gas flow over the blades 17 and vanes 18.

It will be seen therefore that casings in accordance with the present invention facilitates modules that are light as well as having a reduced number of separate parts and are easier to assembly than is the case with conventional casings.

I claim:

1. A gas turbine engine casing comprising a plurality of interconnected ring members coaxially arranged in series relationship, each of said ring members having an annular array of radially inwardly directed stator aerofoil vanes having tips and being integrally attached to said ring members and having means on said vanes to facilitate the attachment of said vanes to adjacent of said ring members whereby together said ring members define said casing, each of said ring members being of frusto-conical configuration at each of its axial extents to accommodate an abradable seal material attached to said ring members, said abradable seal material being so positioned on said ring members as to cooperate with the tips of said aerofoil blades operationally located within said casing, said abradable seal material being arranged in annular arrays, one array being positioned at the axial extent of each of said ring members so that the adjacent abradable material arrays of adjacent ring members operationally cooperate in sealing relationship with the tips of a single array of said aerofoil blades.

2. A gas turbine engine casing as claimed in claim 1 wherein said abradable seal material is retained within an open cell honeycomb structure.

3. A gas turbine engine casing as claimed in claim 1 wherein each of said ring members is provided with integral interconnected reinforcing ribs on its radially outer surface so as to define an isogrid structure.

4. A gas turbine engine casing as claimed in claim 1 wherein those portions of the radially inner surface of said ring members not having said abradable material thereon are provided with a coating of a thermal insulating material.

5. A gas turbine engine casing as claimed in claim 1 wherein a cowl surrounds the radially outer surfaces of said ring members in radially spaced apart relationship so that an annular cooling air passage is defined therebetween.

6. A gas turbine engine casing as claimed in claim 5 wherein said cowl is surrounded by a containment material.

7. A gas turbine engine as claimed in claim 6 wherein said containment material is glass fiber fabric.

8. A gas turbine engine casing as claimed in claim 1 wherein said means to facilitate the attachment of adjacent ring members to each other comprises an annular flange positioned at each of the axial extents of said ring members, adjacent flanges being interconnected by fasteners.

9. A gas turbine engine casing as claimed in claim 8 wherein said fasteners comprise bolts.

10. A gas turbine engine as claimed in claim 1 wherein said casing is a turbine casing.

* * * * *